US009921546B2

(12) United States Patent
Legeret et al.

(10) Patent No.: US 9,921,546 B2
(45) Date of Patent: Mar. 20, 2018

(54) TIMEPIECE MECHANISM COMPRISING A PIVOTING MEMBER PROVIDED WITH MAGNETIC RETURN MEANS

(71) Applicant: Montres Breguet S.A., L'Abbaye (CH)

(72) Inventors: Benoit Legeret, Ecublens (CH); Davide Sarchi, Zurich (CH); Sylvain Dauby, Le Sentier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/289,415

(22) Filed: Oct. 10, 2016

(65) Prior Publication Data

US 2017/0176937 A1 Jun. 22, 2017

(30) Foreign Application Priority Data

Dec. 22, 2015 (EP) ..... 15201933

(51) Int. Cl.
*G04B 5/08* (2006.01)
*G04B 5/16* (2006.01)
(Continued)

(52) U.S. Cl.
CPC ..... *G04B 13/026* (2013.01); *G04B 5/08* (2013.01); *G04B 5/16* (2013.01); *G04B 11/005* (2013.01);
(Continued)

(58) Field of Classification Search
CPC ..... G04B 5/08; G04B 5/16; G04B 11/005; G04B 11/008; G04B 13/026; G04B 15/08; G04D 3/002
See application file for complete search history.

(56) References Cited

U.S. PATENT DOCUMENTS 2,722,617 A * 11/1955 Cluwen ..... H01F 7/0242 310/103
3,058,294 A 10/1962 Zemla
(Continued)

FOREIGN PATENT DOCUMENTS

| | | |
|---|---|---|
| DE | 1 039 945 | 9/1958 |
| FR | 1.276.734 | 11/1961 |
| FR | 1.372.223 | 9/1964 |

OTHER PUBLICATIONS

European Search Report dated Jun. 23, 2016 in European Application 15201933.7 filed on Dec. 22, 2015 (with English Translation of Categories of cited documents & Written Opinion).

*Primary Examiner* — Vit W Miska
(74) *Attorney, Agent, or Firm* — Oblon, McClelland, Maier & Neustadt, L.L.P.

(57) ABSTRACT

The timepiece mechanism comprises a rotating wheel set, a support element, a pivoting member mounted on the support element and magnetic return means for returning one portion of the pivoting member against a surface of the rotating wheel set. The return means comprise a first magnet carried by the pivoting member and a second magnet carried by the support element. The first and second magnets are arranged such that, in normal operation, the interaction of their respective magnetic fields generates a magnetic force oriented to return said pivoting member portion towards said rotating wheel surface. At least one of the first and second magnets is arranged to permit reversal of its polarity, preferably with the aid of a tool, and thereby of the direction of the magnetic force acting on the pivoting member, said magnetic force then tending to move said pivoting member portion away from said rotating wheel set surface, which makes it easy to handle the various elements of the timepiece mechanism.

10 Claims, 3 Drawing Sheets

(51) Int. Cl.

| | |
|---|---|
| ***G04B 11/00*** | (2006.01) |
| ***G04B 13/02*** | (2006.01) |
| ***G04D 3/00*** | (2006.01) |
| ***G04B 15/08*** | (2006.01) |

(52) U.S. Cl.
CPC ..... *G04B 11/008* (2013.01); *G04B 15/08* (2013.01); *G04D 3/002* (2013.01)

(56) References Cited

U.S. PATENT DOCUMENTS 3,058,356 A * 10/1962 Welch ..... F16D 27/08
192/90
3,451,280 A * 6/1969 Hetzel ..... G04B 11/04
368/125

* cited by examiner

TIMEPIECE MECHANISM COMPRISING A PIVOTING MEMBER PROVIDED WITH MAGNETIC RETURN MEANS

This application claims priority from European Patent Application No 15201933.7 of Dec. 22, 2015, the entire disclosure of which is hereby incorporated herein by reference.

FIELD OF THE INVENTION

The present invention generally concerns timepiece mechanisms comprising a rotating wheel set, a support element, a member mounted to pivot on the support element and magnetic return means for returning one portion of the pivoting member against a surface of the rotating wheel set.

PRIOR ART

There are already known timepiece mechanisms comprising magnetic means for coupling two elements, in particular a cam and a follower lever. Thus, FIG. 15 of FR Patent 1276734 represents one part of a self-winding mechanism which is used for conversion of the rotational motion of a rotating wheel set into alternate motions of a pivoting lever. In the illustrated example, the rotating wheel set with which the lever cooperates comprises a trilobate cam and the return means for returning one part of the lever against the surface of the rotating wheel set comprise two permanent magnets. The first magnet is a filiform magnet fixedly carried by the lever and the second magnet is attached to the lever support. It will be noted that the first magnet is also used to partially counter the magnetic return force by means of the arrangement thereof with its north pole located in proximity to the trilobate cam which also forms a magnetic north pole. Thus, the magnetic cam moves remotely, by magnetic repulsion, the head of the first magnet integral with the lever.

As explained above, the invention therefore concerns timepiece mechanisms wherein the return means do not operate by means of a spring, but via a pair of magnets generating a magnetic return force. The use of such magnetic return means has the particular advantage of avoiding any problems with spring fatigue. Indeed, when a spring is repeatedly subjected to repetitive stresses, there is a risk of cracks forming and causing a reduction in the coefficient of elasticity, or even breaking the spring.

However, timepiece mechanisms comprising magnetic return means also have some drawbacks. Indeed, the permanent magnets must be arranged in proximity to each other. In such conditions, the omnipresence of a magnetic interaction force between the magnets renders the operation of assembling such mechanisms difficult. It also complicates any disassembly, particularly for repair, and adjustment of the mechanisms.

BRIEF SUMMARY OF THE INVENTION

It is an object of the present invention to overcome the drawbacks of the prior art by providing a timepiece mechanism of the type described above and wherein the rotating wheel set and the parts cooperating therewith can easily be assembled upon assembly of the mechanism, and then easily removed upon disassembly for checking, cleaning or repair, and finally reassembled without difficulty. The present invention achieves this object by providing a timepiece mechanism conforming to the annexed claim 1.

According to the invention, the timepiece mechanism comprises a rotating wheel set, a support element, a member mounted to pivot on the support element and return means for returning, in normal operation, one portion of the pivoting member against a surface of the rotating wheel set. These return means comprise a first magnet carried by the pivoting member and a second magnet carried by the support element separately from the pivoting member, the first magnet and the second magnet being arranged to occupy, in normal operation, respectively a first position relative to the pivoting member and a second position relative to the support element, these first and second positions being arranged such that the interaction of the respective magnetic fields of these first and second magnets generates a first magnetic force which returns said portion of the pivoting member towards said surface of the rotating wheel set. The first magnet or the second magnet is associated with means for varying its position relative to the pivoting member, respectively to the support element, such that it can occupy a third position in which the interaction of the respective magnetic fields of the first and second magnets generates a second magnetic force which tends to move said pivoting member portion away from said rotating wheel set surface. The means for varying the position of the first or second magnet are arranged such that the change between the first position, respectively the second position, and the third position is reversible.

According to an advantageous variant of the invention, the second magnet is arranged to be able to cooperate with a tool to turn the magnet on itself and thereby to be driven in rotation between the second and third positions, in a reversible manner. One advantage of this variant is that it allows a watchmaker to vary the magnetic interaction in the magnetic system provided and especially to change the direction of the magnetic force on the pivoting member to momentarily hold the pivoting member away from the rotating wheel set, thereby facilitating the assembly or disassembly of the timepiece mechanism.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 1:
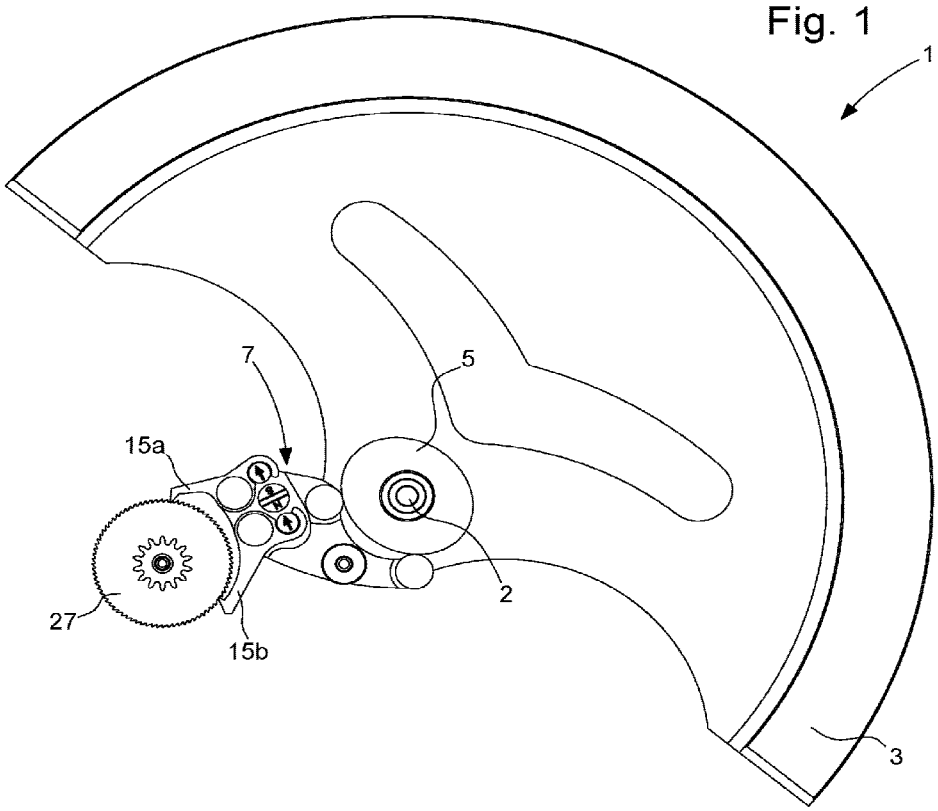
FIG. 1 is a plan view of a self-winding mechanism for a watch which forms a particular embodiment of the timepiece mechanism of the invention.
Figure 2:
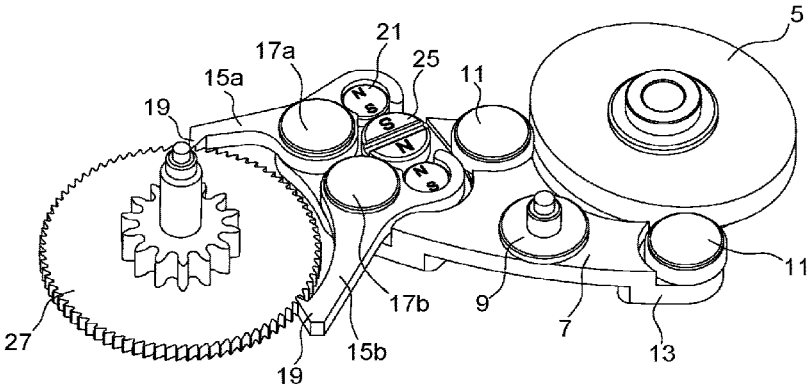
FIG. 2 is an enlarged perspective view of the self-winding mechanism of FIG. 1, with the oscillating weight omitted.

FIGS. 1 and 2 are illustrations of a first particular embodiment of the timepiece mechanism of the invention. In the illustrated example, the timepiece mechanism (generally referenced 1) is a bidirectional self-winding mechanism for timepiece movements. This mechanism comprises an oscillating weight 3 and an eccentric cam 5 fixedly mounted on the oscillating weight, in a coaxial position, such that cam 5 participates integrally with the movement of oscillation of weight 3. As shown in FIG. 1, the cam tales the form of an oval disc having a centre of symmetry 2 through which its axis of rotation passes. It will be understood, however, that, in a known manner, the eccentric cam could also take a different form, for example the form of an ellipse or a heart.

Referring more particularly to FIG. 2, it can be seen that the illustrated mechanism comprises a lever 7 pivoted about an arbor 9. Eccentric cam 5 is in contact with the lever by means of two rollers 11 each mounted on a stud 13 of the lever. When weight 3 pivots in one direction or the other, the interaction between the eccentric cam and the two rollers has the effect of communicating an oscillating motion to lever 7.

Lever 7 of timepiece mechanisms 1 carries two pivoting members 15*a* and 15*b* which are pivoted on the lever about two distinct arbors 17*a*, 17*b*. Each of the pivoting members takes the form of a first-class lever with arms that extend on either side of the pivot axis. A first arm ends in a beak 19 and is arranged to act as a click. Each pivoting member thus defines a click in this example. Next, the second arm of each pivoting member carries a magnet 21 (hereafter the first magnet). The first magnet is preferably mounted inside a housing 23 provided for this purpose. Hereafter, each of the two pivoting members will be referred to as "click" given the function thereof.

Referring again to the Figures, it can also be seen that lever 7 carries another magnet 25 (hereafter the second magnet) mounted separately from the two pivoting members 15*a*, 15*b*. In the example represented, the three magnets 21 and 25 are substantially aligned and situated in a plane perpendicular to the axis of rotation 2 of oscillating weight 3. The second magnet is disposed at a certain distance from the first two magnets 21 on lever 7. It can also be seen that magnets 21 and 25 are disc-shaped and that their polarization direction substantially corresponds to the direction of alignment of the magnets in the plane perpendicular to axis 2.

Timepiece mechanism 1 further comprises a rotating wheel set 27. In the example represented, the rotating wheel set is a ratchet wheel. In a known manner, the ratchet wheel is arranged to be driven by the two clicks 15*a* and 15*b*. In the embodiment illustrated in FIGS. 1 and 2, the two clicks are returned against ratchet wheel 27 in opposite directions. Thus, when lever 7 pivots about arbor 9 in the clockwise direction, click 15*a* is pulled and disengages from the ratchet wheel toothing, whereas click 15*b*, which is also pulled, drives the ratchet wheel. Conversely, when lever 7 pivots about arbor 9 in the anticlockwise direction, click 15*a* is pushed and drives the ratchet wheel, whereas click 15*b*, which is also pushed, disengages from the ratchet wheel toothing. In a conventional manner, the ratchet wheel is arranged to drive the barrel arbor via a gear train in order to wind the mainspring.

Figure 3A:
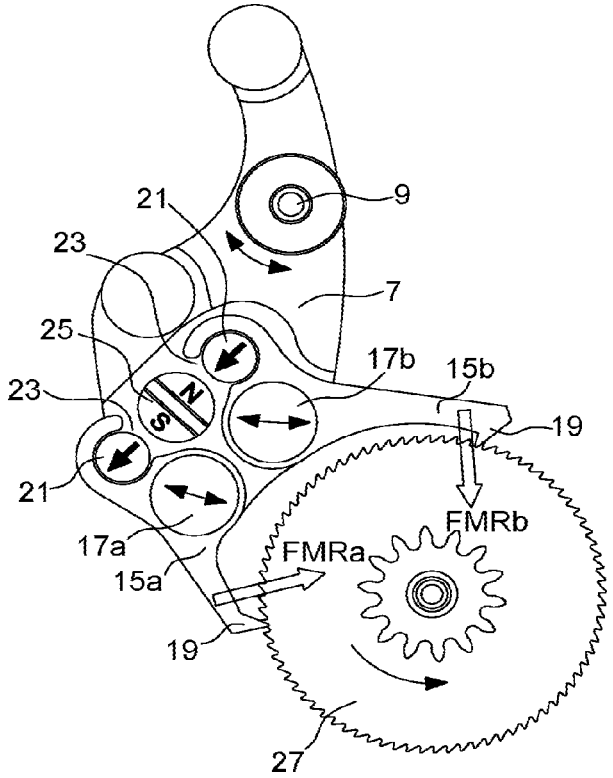
FIGS. 3A and 3B show a partial plan view of the self-winding mechanism of FIGS. 1 and 2, respectively in a normal operating configuration of the self-winding mechanism and in a non-operating configuration of assembly or disassembly of said mechanism.
Figure 3B:
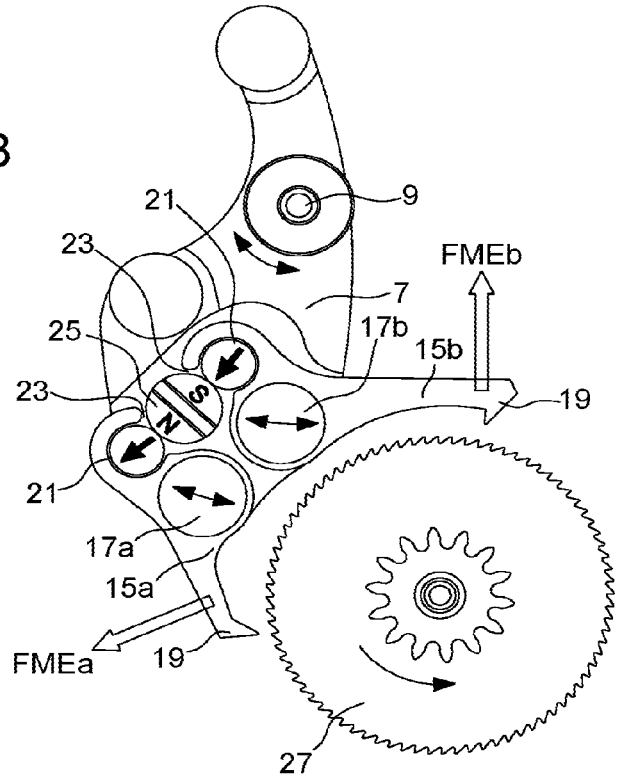

Referring more particularly to FIGS. 3A and 3B, it can be seen that, in normal operation represented in FIG. 3A, the three magnets are arranged alternately as regards their polarization direction (magnetic axis vector. In other words, the first two magnets 21 are polarized in the same direction, whereas the second magnet 25, which is inserted between the first two magnets, is polarized in the opposite direction. In such conditions, the magnets repel each other and a magnetic force of repulsion appears, which generates a magnetic return force FMRa, respectively FMRb, on the two clicks. There results a magnetic return torque exerted in the anticlockwise direction on click 15*a* and a magnetic return torque exerted in the clockwise direction on click 15*b*.

According to the invention, at least one of the first and second magnets 21, 25 is arranged to allow a watchmaker to change its polarization direction, or preferably its sense of polarization (its polarity along the direction of alignment of the magnets) and thereby vary the magnetic force acting on each of clicks 15*a* and 15*b*. In the variant described here, second magnet 25 is arranged to be capable of a 180° rotation with respect to lever 7 on which it is mounted, in a reversible manner, with the aid of a screwdriver. It is thus easy to change the polarity of this second magnet. Thus, starting from the configuration of FIG. 3A, a watchmaker can rotate magnet 25 by a half-turn to move it into another configuration represented in FIG. 3B, namely in a different angular position corresponding to an assembly or disassembly position of the mechanism. In the assembly/disassembly configuration of FIG. 3B, the interaction of the respective magnetic fields of the first and second magnets generates a magnetic force FMEa, respectively FMEb, acting on each click, this magnetic force tending to move beak 19 of each of the two clicks away from the ratchet wheel toothing.

It will be noted that second magnet 25, which is partially housed inside a cavity of lever 7, takes the form of a slotted screw head to allow a watchmaker to rotate the magnet using a screwdriver. According to a variant, the second magnet is mounted inside a rotating housing (not represented) which is in turn housed inside a cavity of the lever, this housing presenting the means for varying the angular position of the second magnet. One advantage of this variant is that it allows the second magnet to rotate without subjecting the latter to mechanical stresses. For example, the housing will be mounted to rotate with friction inside a circular hole in the lever. The friction makes it possible to hold the second magnet in a first angular position during normal operation of the timepiece mechanism. This friction also makes it possible to hold the second magnet in a second angular position, corresponding to a non-operating configuration, once a watchmaker has rotated the housing, particularly during assembly or disassembly of the timepiece mechanism.

When second magnet 25 is rotated by 180°, the three magnets 21, 25 are then polarized in the same sense as represented in FIG. 3B. In these conditions, magnet 21 and magnet 25 each attract each other instead of repelling each other. Thus, a magnetic force of attraction appears in the form of a torque exerted in the clockwise direction on click 15*a* and a torque exerted in the anticlockwise direction on click 15*b*. The two clicks then move away from ratchet wheel 27. As a result of this feature of the invention, the components of the timepiece mechanism can be either easily mounted, or easily removed for checking, cleaning or repair. Moreover, the invention offers a significant advantage for unwind the mainspring of the barrel, for example in order to replace the mainspring. Indeed, as seen above, reversing the polarity of the second magnet makes it possible to keep the two clicks 15*a*, 15 disengaged from the ratchet wheel, and thus from the mainspring.

The invention has yet another advantage, since the ability to rotate a magnet makes it possible to vary the direction of the axis of magnetisation of the magnet and therefore the interaction with the other magnet of the magnetic system concerned, and especially to vary the intensity of the magnetic force between the two magnets. It is therefore possible to adjust the intensity of the magnetic force acting on the pivoting member. Fine adjustment of the magnetic force may be important for optimising the function, especially the intensity of the return force exerted on the pivoting member.

In a first variant, in particular for a click or a jumper spring, the magnet arranged to rotate on of the support element forms a cam, i.e. the magnet is not centred on the axis of rotation thereof. Therefore, varying the angular position of the magnet also moves it closer to or further from the magnet carried by the rotating member. In a second variant, the magnet does not have a cylindrical or square shape, in projection onto a general plane perpendicular to its axis of rotation, but a different shape, for example rectangular or elliptical. As in the first variant, such a configuration makes it possible to vary the intensity of the force exerted in the magnetic system concerned.

Figure 4:
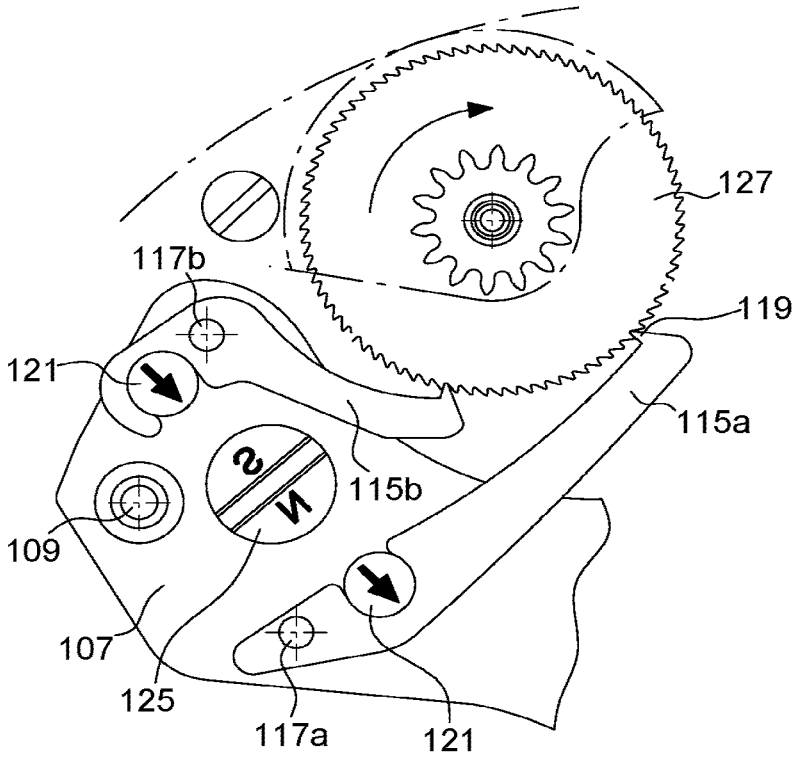
FIG. 4 is a partial view, similar to FIG. 3, which shows a variant embodiment of a self-winding mechanism for a mechanical watch.

FIG. 4 is a partial view, similar to FIG. 3A, of a self-winding mechanism for a watch forming a second variant embodiment of the invention. The mechanism of FIG. 4 comprises a lever 107 (of which only one part is visible) pivoted about an arbour 109. The lever carries two pivoting members 115*a* and 115*b* which are pivoted on the lever about two distinct arbours 117*a* and 117*b*. It will be noted that, unlike the case of the first variant, the arrangement of the pivoting members in FIG. 4 is asymmetrical. Pivoting member 115*a* takes the form of a third-class lever with a single arm extending from pivot arbor 117*a*, whereas pivoting member 115*b* takes the form of a first-class lever with two arms that extend on either side of pivot arbor 117*b*. A first arm of pivoting member 115*b*, which ends in a beak 119 is arranged to act as a click. Moreover, the second arm carries a first magnet 121. Pivoting member 115*a* is also arranged to act as a click, its single arm also ending in a beak 119, and it also carries a first magnet 121 which is disposed between pivot arbour 117*a* and beak 119. It will be understood that it is precisely this intermediate position of the magnet that makes pivoting member 115*a* a third-class lever.

Referring again to FIG. 4, it can also be seen that lever 107 carries a second magnet 125 which is separated from the two pivoting members 115*a*, 115*b*. As in the first variant, the three magnets 121 and 125 are substantially aligned and situated in a plane perpendicular to the axis of rotation of the lever. Moreover, the second magnet is arranged on lever 107 between the two magnets 121 at a certain distance therefrom to prevent the magnets colliding during normal operation of the self-winding mechanism. Again, their polarization direction substantially corresponds to their direction of alignment. The first magnet mounted on pivoting member 115*b* and second magnet 125 are polarized in the same sense. In these conditions, these two magnets attract each other and the magnetic force of attraction appears in the form of a return torque exerted in the anticlockwise direction on pivoting member 115*b*. Likewise, the first magnet mounted on pivoting member 115*a* is polarized in the same sense as second magnet 125. It is therefore attracted by the second magnet. The magnetic force of attraction between the first magnet, mounted on pivoting member 115*a*, and the second magnet 125 appears in the form of a return torque exerted in the anticlockwise direction on pivoting member 115*a*.

It will also be understood that various modifications evident to those skilled in the art may be made to the variant embodiments forming the subject of the present description without departing from the scope of the present invention defined by the annexed claims. In particular, the present invention is not limited to a self-winding mechanism. Indeed, those skilled in the art know of very many other watchmaking applications in which wheels or rings and clicks or jumper springs are implemented. The present invention is capable of being adapted without difficulty to each of these applications. Moreover, clicks and jumper springs are naturally not the only examples of pivoting members capable of being arranged to cooperate with a rotating wheel set. Among examples other than clicks, the following may also be cited: cam control mechanisms, return-to-zero mechanisms using a hammer, engagement coupling mechanisms and lever mechanisms for perpetual calendars.

What is claimed is:

1. A timepiece mechanism comprising a rotating wheel set, a support element, a member mounted to pivot on the support element and return means for returning, in normal operation, a portion of the pivoting member towards a surface of the rotating wheel set, said return means being formed by a first magnet carried by the pivoting member and a second magnet carried by the support element separately from the pivoting member, the first magnet and the second magnet being arranged to occupy, in normal operation, respectively a first position relative to said pivoting member and a second position relative to said support element, said first and second positions being arranged such that the interaction of the respective magnetic fields of said first and second magnets generates a first magnetic force which returns said portion of the pivoting member towards said surface of the rotating wheel set, wherein said first magnet or said second magnet is associated with means for varying the position thereof relative to said pivoting member, respectively to said support element, such that said magnet can occupy a third position in which the interaction of the respective magnetic fields of the first and second magnets generates a second magnetic force which tends to move said pivoting member portion away from said rotating wheel set surface, said means for varying the position of the first or second magnet being arranged such that the change between the first position, respectively the second position and the third position is reversible.

2. The timepiece mechanism according to claim 1, wherein said means for varying the position of the first or second magnet are arranged to allow said magnet to rotate on itself.

3. The timepiece mechanism according to claim 2, wherein said means for varying the position of the first or second magnet are arranged to allow a rotation of 180° about an axis perpendicular to the axis of polarization of said magnet.

4. The timepiece mechanism according to claim 2, wherein said magnet associated with said means for varying the position thereof is the second magnet.

5. The timepiece mechanism according to claim 4, wherein said means for varying the position of the second magnet are formed by a rotating friction arrangement of the second magnet and by a configuration of said second magnet allowing cooperation with a tool to rotate said magnet on itself.

6. The timepiece mechanism according to claim 1, wherein the rotating wheel is a ratchet wheel and the pivoting member defines a click.

7. The timepiece mechanism according to claim 6, wherein the timepiece mechanism is a self-winding mechanism comprising a lever forming said support element, said click being pivoted on the lever.

8. The timepiece mechanism according to claim 7, wherein the mechanism comprises two clicks, mounted to pivot about two distinct arbours on the lever, one of the two clicks being provided with said first magnet and the other of said two clicks being provided with a third magnet arranged relative to said second magnet in a similar manner to said first magnet.

9. The timepiece mechanism according to claim 3, wherein the rotating wheel is a ratchet wheel and the pivoting member defines a click.

10. The timepiece mechanism according to claim 9, wherein the timepiece mechanism is a self-winding mechanism comprising a lever forming said support element, said click being pivoted on the lever.

* * * * *